US009238854B2

(12) United States Patent
Kwon et al.

(10) Patent No.: US 9,238,854 B2
(45) Date of Patent: Jan. 19, 2016

(54) METHOD OF PRODUCING CARBIDE AND CARBON NITRIDE POWDERS CONTAINING BINDER, AND CERMET OBTAINED FROM THE SAME

(71) Applicant: KOREA INSTITUTE OF GEOSCIENCE AND MINERAL RESOURCES, Daejeon (KR)

(72) Inventors: Han-Jung Kwon, Daejeon (KR); Sun-A Jung, Daejeon (KR); Sung-Wook Cho, Daejeon (KR); Dae-Sup Kil, Daejeon (KR); Ji-Woong Kim, Incheon (KR); Ki-Min Roh, Daejeon (KR); Jae-Won Lim, Daejeon (KR)

(73) Assignee: KOREA INSTITUTE OF GEOSCIENCE AND MINERAL RESOURCES, Yuseong-gu, Daejeon (KR)

( * ) Notice: Subject to any disclaimer, the term of this patent is extended or adjusted under 35 U.S.C. 154(b) by 432 days.

(21) Appl. No.: 13/830,613

(22) Filed: Mar. 14, 2013

(65) Prior Publication Data

US 2014/0100103 A1 Apr. 10, 2014

(30) Foreign Application Priority Data

Oct. 10, 2012 (KR) ..... 10-2012-0112417

(51) Int. Cl.
*C22C 29/02* (2006.01)
*C22C 1/05* (2006.01)

(52) U.S. Cl.
CPC ..... *C22C 29/02* (2013.01); *C22C 1/053* (2013.01)

(58) Field of Classification Search
CPC ..... C22C 29/02; C22C 1/053; C22F 1/183
USPC ..... 75/238
See application file for complete search history.

(56) References Cited

U.S. PATENT DOCUMENTS

| | | | |
|---|---|---|---|
| 2009/0277301 | A1 | 11/2009 | Scholl et al. |
| 2010/0184582 | A1 | 7/2010 | Kang et al. |

FOREIGN PATENT DOCUMENTS

| | | | |
|---|---|---|---|
| JP | 01-309901 | A | 12/1989 |
| JP | 04-329844 | A | 11/1992 |
| JP | 2005-68547 | A | 3/2005 |
| JP | 2005-225735 | | 8/2005 |
| JP | 2007-70157 | | 3/2007 |
| JP | 2009-542916 | A | 12/2009 |
| JP | 2010-500477 | A | 1/2010 |
| KR | 1989-0004491 | | 11/1989 |

*Primary Examiner* — Weiping Zhu
(74) *Attorney, Agent, or Firm* — Christie, Parker & Hale, LLP

(57) ABSTRACT

Disclosed is a method of producing carbide and carbon nitride powders containing a binder, and cermet obtained from the same.

The method includes preparing Ti—Ni alloy powders for Ti alloy powders and graphite, planetary-pulverizing the Ti—Ni alloy powders and the graphite, mortar-pulverizing the alloy powders and the graphite which are subject to the planetary-pulverizing, and performing heat treatment for the Ti—Ni alloy powders and the graphite that are pulverized.

Cermet, which is made of the composite powders of carbide and carbon nitride/metal including both TiC which is ceramic material and Ni which is metal is provided.

9 Claims, 4 Drawing Sheets

METHOD OF PRODUCING CARBIDE AND CARBON NITRIDE POWDERS CONTAINING BINDER, AND CERMET OBTAINED FROM THE SAME

CROSS-REFERENCE TO RELATED APPLICATION

This application claims the benefit under 35 U.S.C. §119 of Korean Patent Application No. 10-2012-0112417 filed on Oct. 10, 2012 in the Korean Intellectual Property Office, the entirety of which disclosure is incorporated herein by reference.

BACKGROUND OF THE INVENTION

1. Field of the Invention

The present invention relates to a method of producing carbide and carbon nitride powders containing a binder, and cermet obtained from the same. In more particular, the present invention relates to a method of producing carbide and carbon nitride powders containing a binder, which are used in cermet serving as the material of a cutting tool or a mold, and cermet obtained from the same.

2. Description of the Related Art

Cermet is a compound word of ceramic and metal, which is expressed in English. The cermet refers to a sintered composite materials composed of ceramic mainly including Ti-based carbide, nitride, or carbon nitride, and metal such as nickel (Ni), cobalt (Cc), or iron (Fe).

Since the cermet has several superior properties such as abrasion resistance, the affinity with a workpiece, and a long-term stable life span, the cermet has been spotlighted in a machining field.

In detail, the cermet has a bonded phase of solid phase of carbide or carbon nitride based on transition metal such as Ti, Zr, Hf, V, Nb, Ta, Cr, Ho, or W, and metal such as Ni, Fe, or Co. When producing the cermet, the cermet is produced by sintering the mixture of the transition metal-based carbide and carbon nitride, and the metal.

According to the related art, when carbide and carbon nitride powders for the cermet are synthesized, the carbide and carbon nitride powders for the cermet are synthesized through the reaction between a single element and carbon (C) or nitrogen ($N_2$.)

In addition, commercial cermet is produced in the form of the mixture of carbide and carbon nitride based on various elements, and metal such as nickel (Ni), cobalt (Co), or iron (Fe). Accordingly, in order to produce the commercial cermet, the process of mixing various carbides and carbon nitrides, and various metal components is required. However, generally, the mixing process requires a long time (mostly for 24 hours) to ensure the uniformity.

In this case, to produce cermet having uniform composition, the process of mixing single carbide and carbon nitride, with metal is essentially required.

Therefore, as the number of elements for the production of the cermet is increased, ensuring the uniformity of the material for the cermet is difficult. Accordingly, the mixing process to ensure the uniformity of the cermet may be prolonged.

As the related art of the present invention, there is Korea Patent Publication No. 10-1989-0004491 (published on Nov. 6, 1989).

SUMMARY OF THE INVENTION

An object of the present invention is to easily produce cermet having uniform composition by preparing composite powders of carbon nitride/metal, which is obtained by mixing carbide and carbon nitride with metal, without the process of mixing materials for the cermet, which requires long process time.

In order to accomplish the above object of the present invention, there is provided a method of producing carbide and carbon nitride powders containing a binder. The method includes preparing Ti—Ni alloy powders for Ti alloy powders and graphite, planetary-pulverizing the Ti—Ni alloy powders and the graphite, mortar-pulverizing the alloy powders and the graphite which are subject to the planetary-pulverizing, and performing heat treatment for the Ti—Ni alloy powders and the graphite that are pulverized.

In this case, preferably, in the composition of the Ti—Ni alloy powders, Ti has a content in a range of 65 wt % to 88 wt. %, and Ni has a remaining content of the composition of the Ti—Ni alloy powders.

In addition, preferably, the Ti—Ni alloy powders are mixed with the graphite at the ratio (mole ratio) of 1:1.

Further, the planetary-pulverizing of the Ti—Ni alloy powders and the graphite may be performed in a planetary ball mill.

In addition, preferably, in the planetary-pulverizing of the Ti—Ni alloy powders and the graphite, the Ti—Ni alloy powders are subject to a milling-pulverizing process such that an average particle size of the Ti—Nd alloy powders is in a range of about 0.2 μm to about 1 μm.

Besides, in the planetary-pulverizing of the Ti—Nd alloy powders and the graphite, the graphite and nickel (Ni) may be amorphorized.

Further, preferably, the planetary-pulverizing of the Ti—Ni alloy powders and the graphite is performed in an inert gas atmosphere.

In addition, the planetary-pulverizing of the Ti—Ni alloy powders and the graphite may be performed in a nitrogen ($N_2$) gas atmosphere.

Further, in the planetary-pulverizing of the Ti—Ni alloy powders and the graphite, carbide and carbon nitride may be formed.

In addition, preferably the heat treatment for the Ti—Ni alloy powders and the graphite is performed at a temperature in a range of 1000° C. to 1300° C. for one hour to two hours.

Further, the heat treatment for the Ti—Ni alloy powders and the graphite may be performed at the vacuum atmosphere, the inert gas atmosphere, or the $N_2$ atmosphere.

Meanwhile, according to the present invention, composite powders of carbide and carbon nitride/metal may be prepared, in the composite powders including both TiC which is ceramic material and Ni which is metal. The cermet having uniform composition may be acquired from the composite powders.

As described above, according to the method of producing carbide and carbon nitride powders containing a binder of the present invention, the powders for the cermet can be rapidly produced by pre-mixing carbide and carbon nitride with metal uniformly.

In addition, the cermet including the composite powders of carbon nitride/metal can be obtained.

DETAILED DESCRIPTION OF THE INVENTION

The advantages, the features, and schemes of achieving the advantages and features of the present invention will be apparently comprehended by those skilled in the art based on the embodiments, which are detailed later in detail, together with accompanying drawings. The present invention is not limited to the following embodiments but includes various applications and modifications. The embodiments will make the disclosure of the present invention complete, and allow those skilled in the art to completely comprehend the scope of the present invention. The present invention is only defined within the scope of accompanying claims.

Hereinafter, the method of producing carbide and carbon nitride powders containing the binder according to the exemplary embodiment of the present invention will be described in detail with reference to accompanying drawings.

Figure 1:
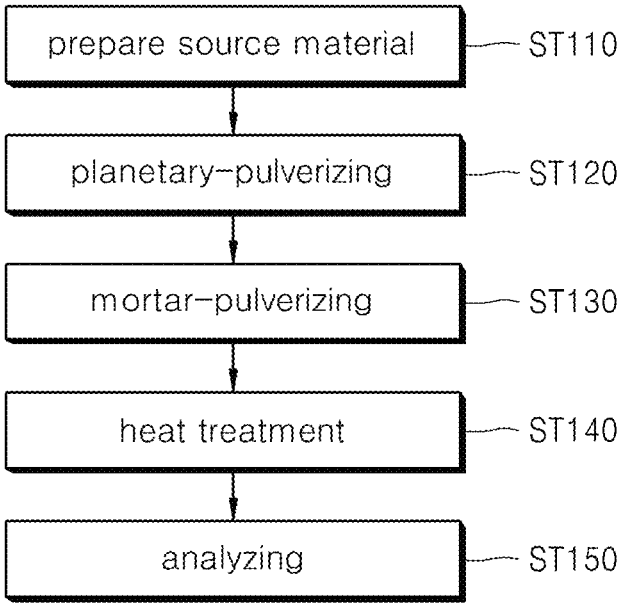
FIG. 1 is a schematic flowchart showing the processes of a method of producing carbide and carbon nitride powders containing a binder according to exemplary embodiments of the present invention.

Referring to FIG. 1, a method of producing carbide and carbon nitride powders containing a binder of the present invention includes a source material preparing step (step ST110), a planetary pulverizing step (step ST120), a mortar pulverizing step (step ST130), a heat treatment step (step ST140), and an analyzing step (step ST150).

Preparation of Source Material

In the source material preparing step (step ST110), 100 g of Ti—Ni alloy powders containing nickel (Ni) serving as a binder component of the cermet, and 18 g of graphite powders are prepared, so that the mole ratio of graphite to an alloy is 1:1.

Figure 2:
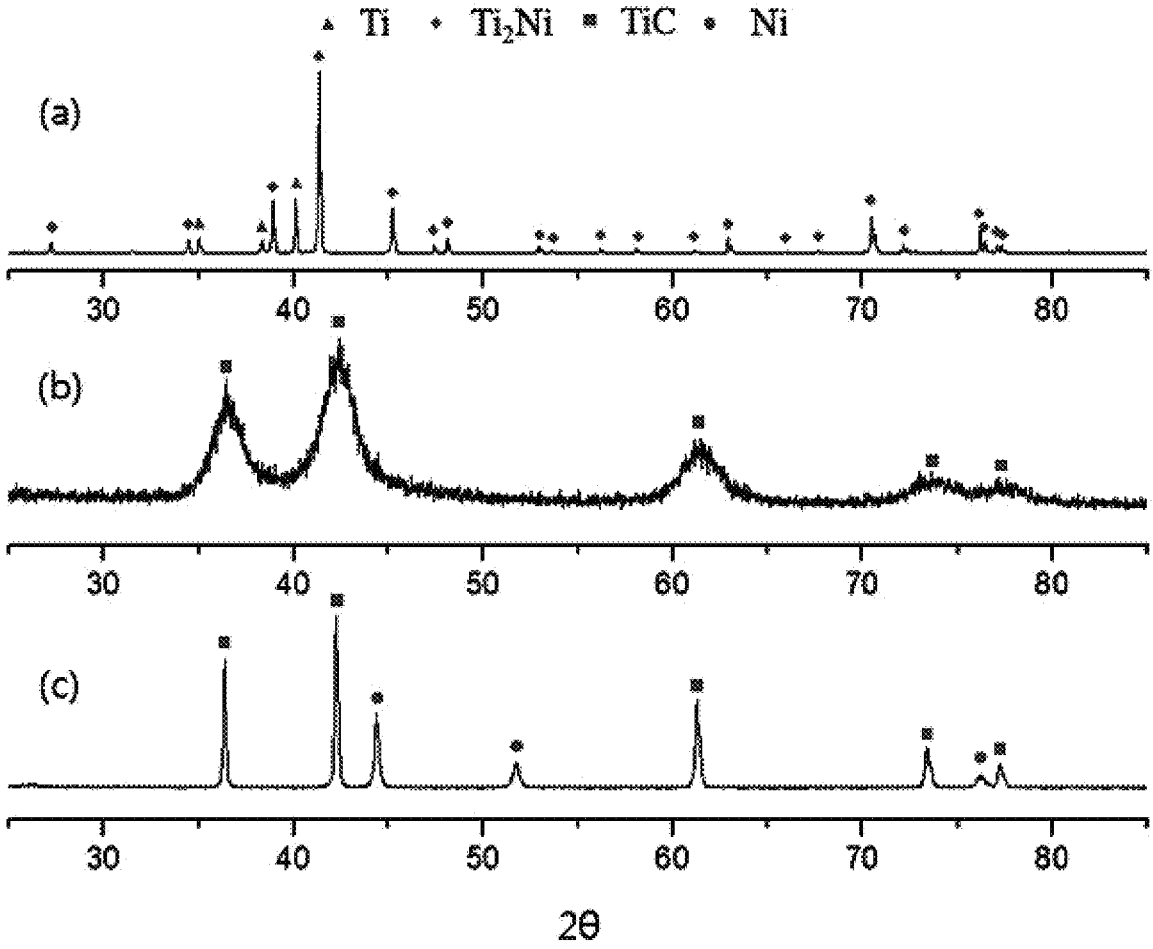
FIGS. 2(*a*) to 2(*c*) are photographs showing patterns of the Ti—Ni-based alloy and the graphite, which are acquired through an XRD scheme, in which FIG. 2(*a*) is a photograph showing an XRD pattern of Ti—Ni powders, FIG. 2(*b*) is a photograph showing an XRD pattern of powders obtained by planetary-pulverizing the mixture of the Ti—Ni powders and the graphite, and FIG. 2(*c*) is a photograph showing the XRD pattern of the planetary-pulverized powders after being subject to the heat treatment at a vacuum state.

The experimental results of the method of producing carbide and carbon nitride powders containing the binder according the present invention are shown through the photographs of the XRD of FIGS. 2(*a*) to 2(*c*).

Here, regarding the composition of the Ti—Ni alloy powders, preferably, 65 wt. % to 88 wt. % of Ti is prepared, and Ni occupies the remaining content of the composition of the Ti—Ni alloy powders.

In this case, the Ti—Ni alloy powders are limited to the above composition because the content of the metallic component of the commercial cermet is in the range of 10 wt. % to 30 wt. % (the content of the carbide and carbon nitride is in the range of 90 wt. % to 70 wt. %), and the content of Ni of the Ti—Ni alloy powders is in the range of 12 wt. % to 35 wt. %.

If the content of the carbide and carbon nitride, which are produced by combining Ti of the Ti—Ni alloy powders serving as the source material with graphite, is less than 70 wt. %, the desired hardness may not be ensured when producing the cermet, and if the content of the carbide and carbon nitride exceeds 90 wt. %, the toughness of the cermet is lowered, which result in limiting the composition of the Ti—Ni alloy powders.

In addition, preferably, the Ti—Ni alloy powders are mixed with the graphite to the extent that the mole ratio of the Ti of the Ti—Ni alloy powders to the graphite is 1:1.

If the Ti—Ni alloy powders are mixed with the graphite at the mole ratio of Ti of the Ti—Ni alloy to the graphite which is less than 1:1 when the Ti—Ni alloy powders are mixed with the graphite, the content of the graphite is excessive when the Ti—Ni alloy powders and the graphite are planetary-pulverized and subject to the heat treatment, so that the free carbon contained in the carbide and the carbon nitride, which is obtained as a result, exerts an undesirable influence on the sintering characteristic. If the Ti—Ni alloy powders are mixed with the graphite at the mole ratio of Ti of the Ti—Ni alloy to the graphite which is equal to or larger than 1:1 when the Ti—Ni alloy powders are mixed with the graphite, Ti is fully not carbonitrided when the planetary-pulverizing and the heat treatment are performed, so that a Ti component remains.

Figure 3:
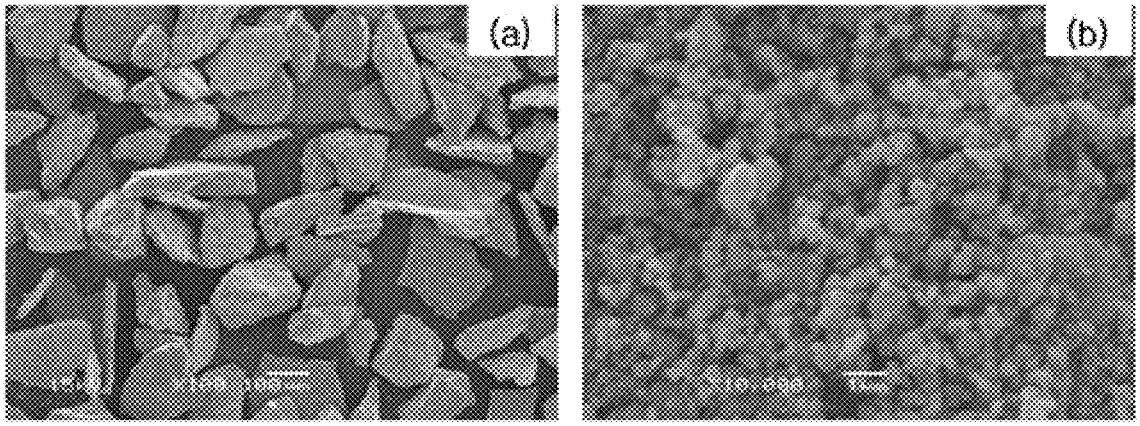
FIGS. 3(*a*) and 3(*b*) are SEM photographs showing Ti—Ni alloy and the powders obtained after the Ti—Ni alloy and graphite are planetary-pulverized and subject to the heat treatment, in which FIG. 3(*a*) is an SEM photograph showing the Ti—Ni alloy, and FIG. 3(*b*) is an SEM photograph showing powders obtained after the mixture of the Ti—Ni alloy and the graphite has been planetary-pulverized.

Meanwhile, the average particle size of the Ti—Ni alloy powders according to the present invention is in the range of about 75 μm to about 150 μm (see FIG. 3(*a*)), and the average particle size of the graphite is in the range of about 7 μm to about 11 μm.

Planetary Pulverizing

In the planetary pulverizing step (step ST120), the source material prepared in the source material preparing step (step ST110) are planetary-pulverized.

In this case, the planetary pulverizing process refers to a milling-pulverizing process performed by a planetary ball mill.

The planetary ball mill includes at east one pulverizing vessel eccentrically provided from a sun wheel or a sun gear. Preferably, the planetary ball mill is designed for the sun wheel to move in the direction opposite to the moving direction of the pulverizing vessel.

In the planetary pulverizing step (step ST120), the Ti—Ni alloy powders and graphite powders, which are prepared in the source material preparing step (step ST110), are introduced into the planetary ball mill and then subject to the milling-pulverizing process.

The Ti—Ni alloy powders and the graphite powders may be simultaneously or sequentially introduced into the planetary ball mill.

In the planetary pulverizing step (ST120), the Ti alloy powders are subject to the milling-pulverizing process so that the Ti alloy powders have the average size of about 0.2 μm to about 1 μm (see FIG. 3(*b*)). In this case, the graphite is subject to the milling-pulverizing process to be converted to an amorphous state in the Ti—Ni alloy powders.

In addition, after the Ti—Ni alloy powders serving as the source material have been the planetary-pulverized, Ti is separated from Ni. The Ti reacts with both of nitrogen ($N_2$) and the graphite to form the carbide and the carbon nitride, and the Ni is converted to the amorphous state (see FIG. 2(*b*)).

In this case, the average article size of the Ti—Ni alloy powders belongs to the milling-pulverizing process condition of the planetary ball mill according to the present invention.

Accordingly, if another milling machine or another pulverizing condition is used, the Ti—Ni alloy powders may be more finely pulverized.

Meanwhile, the planetary pulverizing step (step ST120) is preferably performed at the inert gas atmosphere. In particular, planetary pulverizing step (step ST120) is most preferably performed at the Ar atmosphere.

In addition, if the planetary pulverizing step (step ST120) performed at the nitrogen ($N_2$) atmosphere, the composite powders of carbon nitride/metal may be formed in the pulverizing step.

Mortar Pulverizing

The mortar pulverizing step (step ST130) is to decompose an agglomerate of the Ti—Ni alloy powders, which are pulverized the planetary pulverizing step (step ST120), and the amorphized graphite, in which the agglomerate is produced during the planetary pulverizing step.

In the present mortar pulverizing step (step ST130), the agglomerate is decomposed to facilitate the synthesis of the carbide and the carbon nitride containing the binder according to the present invention by using a mortar including alumina.

Accordingly, the particle size of the Ti—Ni alloy powders is reduced to the smaller size of less than 1 μm and the graphite is amorphized, so that the reaction between the Ti—Ni alloy powders and the graphite may be made at the temperature less than the existing reaction temperature (>1800° C.) when performing the heat treatment (described below).

The reaction may be made at the lower temperature as described above because the size of the Ti—Nd alloy particle is reduced to have a wider surface area, so that the contact area between the Ti—Ni alloy particles and the graphite is increased, and the amorphized graphite is unstable to increase the driving force for the reaction.

Meanwhile, preferably, the mortar pulverizing step (step ST130) is performed at the inert gas atmosphere. Especially, the mortar pulverizing step (step ST130) is preferably performed at the Ar atmosphere.

Heat Treatment

The heat treatment step (step ST140) is to produce carbon nitride through the heat treatment of the Ti alloy powders and the amorphized graphite, which are obtained in the mortar pulverizing step (step ST130), at the temperature of 1000° C. to 1300° C.

In this case, if the heat treatment temperature is less than 1000° C., the reaction to form the carbon nitride is not completed, and an amount of oxygen contained in the powders may be increased. If the heat treatment temperature exceeds 1300° C., particles are grown due to the strong cohesion, so that powders unsuitable for production of the cermet may be formed.

The present heat treatment step (step ST14) may be performed at the vacuum atmosphere in order to prevent the oxidation reaction during the heat treatment.

Meanwhile, the present heat treatment step (step ST140) is preferably performed for one hour to two hours.

In this case, if the time to progress the heat treatment is less than one hour, the reaction to form the carbon nitride is not completed, so that the metal phase may partially remain. If the heat treatment time exceeds three hours, the particles are grown due to the strong cohesion, so that the powders unstable for the production of the cermet may be formed.

Analyzing

The analyzing step (step ST150) is to determine the phase of the carbide and the carbon nitride powders containing the binder produced through the heat treatment step (step ST140) through an X-ray diffraction scheme.

The analyzing results are shown in FIGS. 2(*a*) and 2(*b*).

Figure 4:
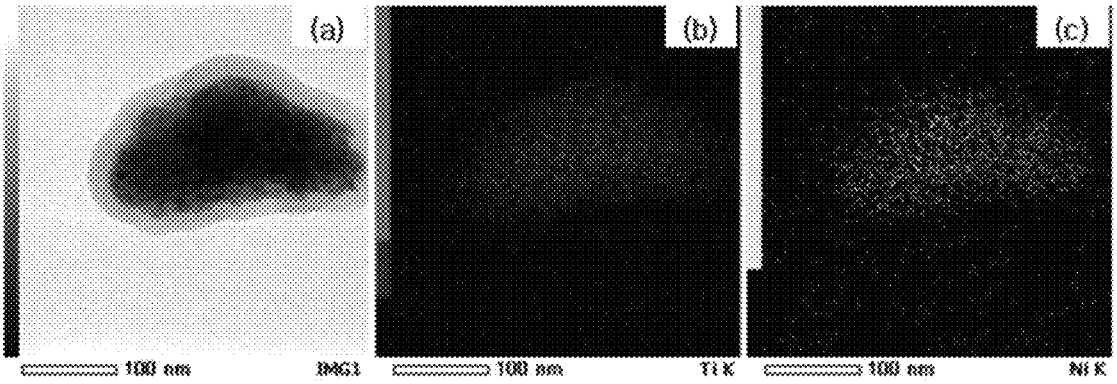
FIGS. 4(*a*) to 4(*c*) are TEM photographs showing the shape and the component analysis of powders after the Ti—Ni alloy and the graphite are planetary-pulverized and subject to the heat treatment, in which FIG. 4(*a*) is a TEM photograph showing powders, FIG. 4 (*b*) is a TEM photograph showing the distribution Ti elements in the powders, and FIG. 4(*c*) is a TEM photograph showing the distribution of Ni elements.

The cermet prepared through the steps ST110 to ST150 is not subject to the mixing process of a single carbon nitride and a metallic component. Accordingly, the cermet is not only prepared within the shorter time, but also has more uniform composition when comparing with the conventional technology The powders having uniform composition may be recognized by detecting the distribution of elements contained in the powders through the TEM element analysis of FIG. 4. Accordingly, those skilled in the art can easily comprehend the uniformity of the composition of the cermet produced according to the present invention.

Embodiment

Hereinafter, the construction and the operation of the preset invention will be described in more detail according to the exemplary embodiment of the present invention.

However, the exemplary embodiment of the present invention is provided for the illustrative purpose, and the present invention is not limited thereto.

Since other advantages and other characteristics that are not described herein can be sufficiently and technically comprehended by those skilled in the art, the details thereof will be omitted in order to avoid redundancy.

First, according to the method of producing carbide and carbon nitride powders containing the binder according to the present invention, 100 g of Ti—Ni alloy powders for Ti alloy powders and 18 g of graphite powders were provided as source materials in order to produce the composite powders of carbon nitride/metal.

The prepared Ti—Ni alloy powders and the graphite were subject to the milling-pulverizing process at the Ar atmosphere in the planetary ball mill.

In this case, as described above, if the atmosphere of the planetary ball mill is set to the nitrogen ($N_2$) atmosphere, the composite powders of carbon nitride/metal may be prepared.

As described above, after the milling-pulverizing process, the agglomerate, which was produced during the planetary pulverizing process, was decomposed by performing the mortar pulverizing process for the Ti—Ni alloy powders and the amorphized graphite.

Thereafter, the heat treatment is performed at the temperature of 1000° C. to 1300° C. under the vacuum atmosphere for one hour to two hours, thereby producing the composite powders of the carbide and carbon nitride/metal.

FIGS. 2(*a*) to 2(*c*) show the experimental results for the Ti—Ni alloy powders.

As shown in FIG. 2(*a*), through the XRD analysis for the Ti—Ni alloy powders, it can be recognized that the Ti—Ni alloy powders have a Ti phase or a $Ti_2Ni$ phase.

When the Ti—Ni alloy powders and the graphite is mixed and planetary-pulverized in the planetary ball mill, TiC is synthesized, which is recognized by a mark "▩" in FIG. 2(*b*).

In this case, since the graphite, which is planetary-pulverized together with the Ti—Ni alloy powders, is amorphized as described above, the peak value does not appear on the XRD pattern. In addition, since the Ni component of Ti—Ni is amorphized, the phase of the Ni component is not recognized on the pattern.

Meanwhile, as shown in FIG. 2(*c*), after the heat treatment has been performed at the vacuum atmosphere through the mortar pulverizing step, all Ti—Ni alloy phases of the source material disappear, and the composite powders of the carbide/metal including the mixture of TiC, which is a ceramic material, and Ni which is metal are produced.

In addition, it can be recognized from FIG. 3 that the particle size of the powders after the heat treatment is in the range of 0.2 μm to 1 μm. Further, it can be recognized from the TEM element analysis of FIG. 4 that the powders having uniform composition is produced.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A method of producing carbide and carbon nitride powders containing a binder, the method comprising:

preparing Ti—Ni alloy powders for Ti alloy powders and a graphite;

planetary-pulverizing the Ti—Ni alloy powders and the graphite;

mortar-pulverizing the alloy powders and the graphite which are subject to the planetary-pulverizing; and performing heat treatment for the Ti—Ni alloy powders and the graphite that are pulverized.

2. The method of claim 1, wherein, for the composition of the Ti—Ni alloy powders, Ti has a content in a range of 65 wt. % to 88 wt. %, and Ni has a remaining content of the composition of the Ti—Ni alloy powders.

3. The method of claim 2, wherein the Ti—Ni alloy powders are mixed with the graphite such that a mole ratio of the Ti—Ni alloy powders to the graphite is 1:1.

4. The method of claim 1, wherein the planetary-pulverizing of the Ti—Ni alloy powders and the graphite is performed in a planetary ball mill.

5. The method of claim 4, wherein, in the planetary-pulverizing of the Ti—Ni alloy powders and the graphite, the Ti—Ni alloy powders are subjected to a milling-pulverizing process such that the average particle size of the Ti—Ni alloy powders is in a range of about 0.2 μm to about 1 μm.

6. The method of claim 5, wherein, in the planetary-pulverizing of the Ti—Ni alloy powders and the graphite, the graphite and nickel (Ni) are amorphized.

7. The method of claim 6, wherein the planetary-pulverizing of the Ti—Ni alloy powders and the graphite is performed in an inert gas atmosphere.

8. The method of claim 7, wherein the planetary-pulverizing of the Ti—Ni alloy powders and the graphite is performed in a nitrogen ($N_2$) gas atmosphere.

9. The method of claim 1, wherein the heat treatment for the Ti—Ni alloy powders and the graphite is performed at a temperature in a range of 1000° C. to 1300° C. for one hour to two hours.

* * * * *